United States Patent [19]

Schlueter

[11] 4,326,739

[45] Apr. 27, 1982

[54] FASTENER WITH PIVOTABLE HANDLE MEMBER

[75] Inventor: Ernest Schlueter, Troy, N.Y.

[73] Assignee: Simmons Fastener Corporation, Albany, N.Y.

[21] Appl. No.: 114,958

[22] Filed: Jan. 24, 1980

[51] Int. Cl.[3] ..... E05C 5/00

[52] U.S. Cl. ..... 292/247; 292/DIG. 49

[58] Field of Search ..... 292/113, 114, 247, DIG. 42, 292/DIG. 49

[56] References Cited

U.S. PATENT DOCUMENTS

| | | | |
|---|---|---|---|
| 247,547 | 9/1881 | Eiseman | 292/113 |
| 347,101 | 8/1886 | Ferry | 292/247 |
| 1,350,713 | 8/1920 | Ferndon | 292/247 |
| 2,154,001 | 4/1939 | Green | 292/113 |
| 2,605,123 | 7/1952 | Claud-Mantle | 292/113 |
| 3,259,411 | 7/1966 | Griffiths | 292/113 |
| 3,309,115 | 3/1967 | Langer | 292/113 X |

*Primary Examiner*—Richard E. Moore

*Attorney, Agent, or Firm*—Eliot S. Gerber

[57] ABSTRACT

A fastener with a pivotable handle member comprises a fixed hasp to be secured to one panel and a lever assembly to be secured to the opposite panel. The lever assembly includes a bracket member having opposite side portions each having an opening to rotatably support the shaft portions of a pivotable handle member. The handle member has eccentric wing portions which provide camming force when pivoted within the curved portions of a movable hasp member which moves to open or close the fastener.

2 Claims, 7 Drawing Figures

FASTENER WITH PIVOTABLE HANDLE MEMBER

BACKGROUND OF THE INVENTION

The present invention relates to industrial fasteners used to releasably secure one panel to another.

The field of industrial fasteners has received considerable attention over the years, both in this country and abroad, from engineers, inventors and designers. Many millions of industrial fasteners are used each year and the industrial fastener field comprises numerous companies, both large and small, who seek to obtain market acceptance of their fasteners on the basis of such factors as price, strength, appearance, reliability and ease of operation.

One type of widely employed fastener is used to removably secure one panel to another. For example, the first panel may be the descending flange of the top of a case and the second panel may be a side wall of the case.

A metal toggle latch is shown in U.S. Pat. No. 4,049,301 in which a lever is rotated upwardly and toward the keeper in order to close the latch. The lever pivots on a pin carried by the side walls of a bracket. The lever carries a second pin which forms the pivot for the drawbar. That toggle latch uses two pins and the lever assembly comprises three complex metal members, namely, the lever, the bracket and the drawbar.

In U.S. Pat. No. 1,791,891 at FIGS. 1-11 a release mechanism is employed to permit, upon its release, the rotation of a headlamp frame. A spring may be spread open by rotation of a lever; however, the lever does not pivot about a center and does not have extension portions. A fastener having a toggle joint and constructed of wire is shown in U.S. Pat. No. 1,090,634. The fastener is closed by operation of the handle upwards and toward the keeper (eye). Similarly, in U.S. Pat. Nos. 3,088,623 and 3,172,205 the fasteners are closed by operation of the handle toward the panels, in both fasteners the handle (lever member) being mounted on pins.

In U.S. Pat. No. 3,193,314 the handle is mounted on one pin and the catch member on a different pin.

OBJECTIVES AND FEATURES OF THE INVENTION

It is an objective of the present invention to provide a fastener to removably secure two panels, which fastener is composed of relatively few parts so that it may be relatively reliable in operation and also relatively low in cost.

It is an objective of the present invention to provide a fastener to removably secure two panels, which fastener may be relatively easily opened or closed by the user and yet will be relatively secure against accidental opening.

It is an objective of the present invention to provide a fastener to removably secure two panels, which fastener presents a pleasing, modern and functional appearance to add to the value, on the basis of appearance, of those items on which it is used.

It is a feature of the present invention to provide a fastener comprising a fixed hasp adapted to be fixed to one panel and a lever assembly adapted to be connected to a second panel. The lever assembly comprises a bracket member, a handle member and a moving hasp member.

The bracket member is a formed sheet metal member having a base portion adapted to be connected to said second panel and having opposite sides preferably perpendicular to the base portion. Each of the sides has an opening, preferably a round hole.

The handle member is a formed sheet metal member having an elongated lever portion which is adapted to be grasped and operated by the user, and a paddle portion. The paddle portion is rectangular, elongated and extends at both sides from the lever portion to form, in plan view, a "T" shape with said lever portion. The handle member also has opposite extending shaft portions extending from the paddle portion. The shafts are rotatably positioned in the respective side openings.

The moving hasp member has a hook-like end portion which hooks onto the fixed hasp, a body portion, and two curved portions each forming a bore and each bore containing an opposite wing portion of the paddle, with each wing being between a shaft and the lever portion. The shaft portions in the openings form a center of turning and the two wing portions are eccentric to that center.

BRIEF DESCRIPTION OF THE DRAWINGS

Other objectives and features of the present invention will be apparent from the following detailed description which provides the inventor's best mode of practicing the invention, the detailed description being taken in conjunction with the accompanying drawings.

In the drawings.

DETAILED DESCRIPTION OF THE INVENTION

Figure 1:
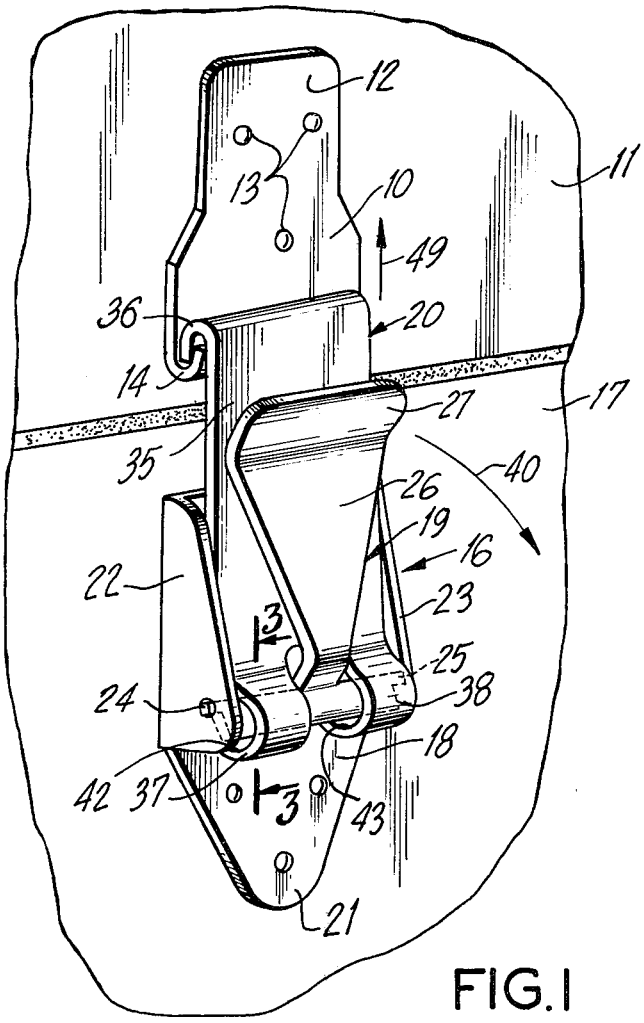
FIG. 1 is a perspective view of a fastener, which is the first embodiment of the present invention, showing the fastener attached to respective panels and with the fastener in its closed position.

As shown in FIG. 1, the fastener of the present invention includes a fixed hasp 10 which is adapted to be secured to the first panel 11. The fixed hasp comprises a flat base portion 12 having three holes. Screws 13 through each of the holes secure the base portion 12 to the panel 11. Alternatively, rivets, adhesive or other connecting means may be utilized to secure the base portion 12 to the panel 11. The bottom end of the fixed hasp 10 is turned over to form a hook-like end portion 14. Preferably the fixed hasp is formed, for example, by forming of a suitable sheet metal, for example, steel.

The fastener of the present invention also includes a lever assembly 16 which is secured to the second panel 17. The lever assembly comprises a bracket member 18, a handle member 19 and a movable hasp member 20. The bracket member 18 consists of a flat base portion 21 having holes through which screws, or other fastening means, fix the base portion 21 to the second panel 17. the bracket member 18 has opposite standing side portions 22 and 23, which side portions are preferably perpendicular to the base portion 21. Each of the side portions has an opening, respectively 24,25, which is preferably a round hole.

Figure 2:
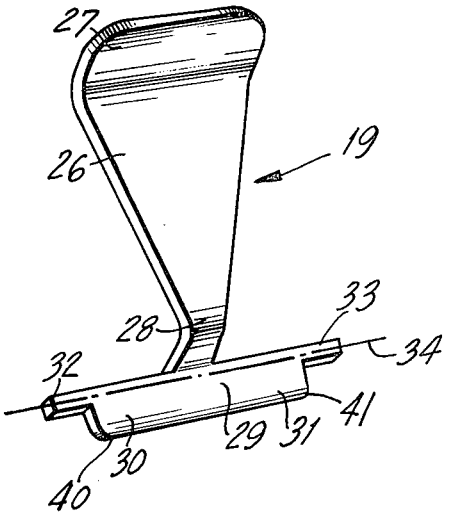
FIG. 2 is a perspective view of the handle member of the fastener shown in FIG. 1.

The handle member 19, as seen best in FIG. 2, comprises a lever portion 26 having a curved outer end 27 so that it may more readily be grasped by the fingers of the user, a narrow neck portion 28 and a paddle portion 29. The paddle portion 29 has opposite wing portions 30 and 31 each of which has a respective extending shaft portion 32,33. The shaft portion 32 rotates within the opening 24 and the shaft portion 33 rotates within the opening 25. The shaft portions 32,33 form a center of turning 34 which generally will be an imaginary axis taken through the centers of openings 24, 25. The wing portions 30 and 31 are eccentric to the center of turning 34.

The movable hasp member 20 comprises a body portion 35, a turned-over end forming a hook-like end portion 36, and curved portions 37 and 38. The curved portions 37 and 38 form perferably round bores (channels) which enclose the respective wing portions 30,31. Preferably the movable hasp member 20, the handle member 19 and the bracket member 18 are each formed as a unitary sheet metal member, for example, stamped from sheet metal steel.

Figure 3:
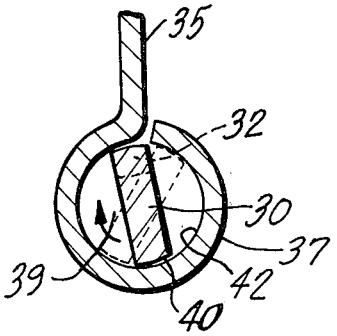
FIG. 3 is an enlarged cross-sectional view taken along lines 3—3 of FIG. 1 with the view in the direction of the arrows.

As shown in FIG. 3, the shaft portion 32 is rotated in the direction of the arrow 39 upon opening of the fastener by rotation of its handle member 19, the opening direction being shown by the arrow 44 of FIG. 1. Upon such rotation the shaft portions 32,33 rotate within the openings 24,25. The eccentric wing portions 30,31 cam at their faces 40,41 against the inside surface 42,43 of their respective curved portions 37,38, moving the movable hasp member 20 upwardly in the direction of arrow 49 of FIG. 1, thereby releasing the fixed hasp 10.

Conversely, to bring the fixed hasp 10 closer to the bracket member 18, the user, by hand, engages the hook-like end portion 36 of the movable hasp member 20 in the hook-like end 14 of the fixed hasp. He then rotates the handle member 19 in the direction opposite to the direction of the arrow 44. The movement of the eccentric wing portions 30,31 will then be from the dotted position shown in FIG. 3 to the full line position shown in FIG. 3, i.e., in the direction opposite to the arrow 39. Such cam motion will move the movable hasp member 20 downwardly, i.e., in the direction opposite to the arrow 44, thereby closing the fastener.

Figure 4:
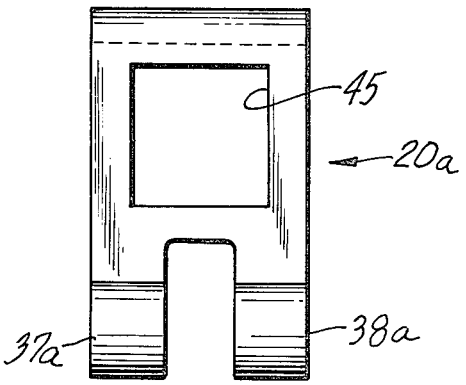
FIG. 4 is a front plan view of an alternative moving hasp member which may be utilized in the fastener of the present invention.

In the embodiment shown in FIG. 4, the movable hasp member **20*a* is similar in many respects to the movable hasp member 20. However, in this embodiment the curved portions 37*a*, 38*a* are formed with the curvature in the opposite direction so that the opening is on top of the hasp member instead of the bottom. In addition, an opening 45 is formed in the moving hasp member 20*a* so that the member is lighter. The side arms 45 in FIG. 6** may be curved to provide a spring action (tending to flatten the curve) when the fastener is closed. The side arms straighten out and act as straight members.

Figure 5:
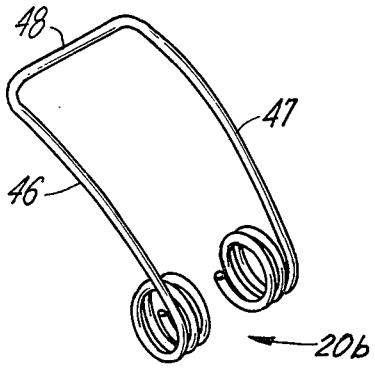
FIG. 5 is a perspective view of another moving hasp member which may be used in the present invention.

In the embodiment of FIG. 5 the movable hasp member **20*b* is formed of wire stock, for example, of spring steel wire. In this embodiment the wire forms side arms 46 and 47 and an end clasp 48. The end clasp 48 would fit within the hook-like end portion 14 of the fixed hasp. The arms 46 and 47 are curved so that, upon closure of the fastener, they may be straightened. This straightening action of the spring arms 46 and 47 places the fastener under a spring load. In other words, the movement of the handle 19 causes the arms 46 and 47** to straighten in addition to closing the fastener.

Figure 6:
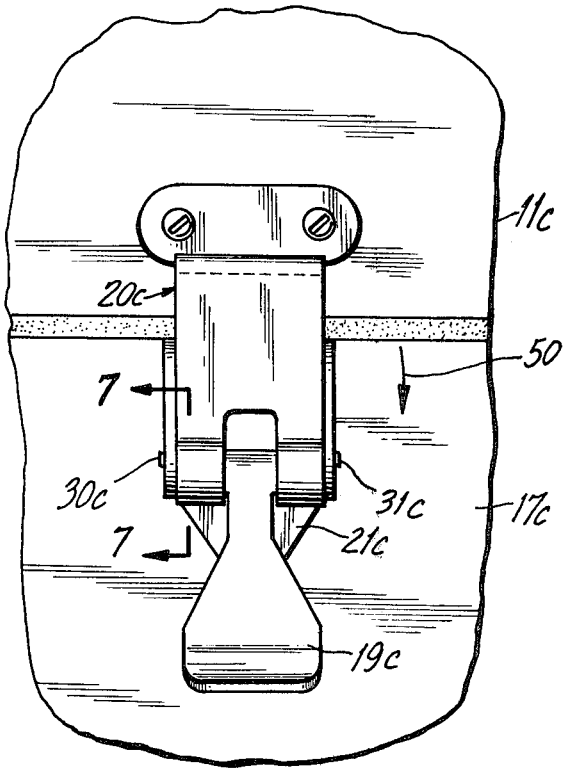
FIG. 6 is a front plan view of a second embodiment of the fastener of the present invention, showing the fastener in its closed position.
Figure 7:
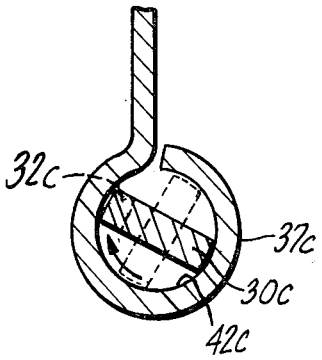
FIG. 7 is an enlarged cross-sectional view taken along line 7—7 of FIG. 6, with the view in the direction of the arrows.

In the embodiment of the fastener of the present invention shown in FIGS. 6 and 7 the fixed hasp, the bracket member **21*c* and the movable hasp 20*c* are preferably all of the same shape, form and function as in the embodiment shown in FIGS. 1–3. However, the direction of the eccentric portion of the paddle portion is reversed relative to its handle member. Consequently, the fastener of FIGS. 6 and 7 closes when the handle member 19*c* is rotated away from the movable hasp member 20*c*, i.e., in the direction of arrow 50 of FIG. 6. That fastener is opened by the rotation of its handle member 19*c* in the direction opposite to the arrow 50**.

As shown in FIG. 7 the wing **30*c* rotates in the direction of the arrow on closing the fastener from its full-line position to its dash-line position. On opening the fastener the wing 30*c* rotates from its dash line to its full-line position. The cam action of the wings 30*c*, 31*c* on the inside surface 42*c*, 43*c* of the moving hasp member 20*c*** causes the movement of the moving hasp member.

Although not shown, the fastener of the present invention may be employed to secure members at an angle, for example, to secure panels at 45° or 90° or at other angles relative to each other.

What is claimed is:

1. A fastener comprising a fixed hasp adapted to be fixed to one panel and a lever assembly adapted to be connected to a second panel, said lever assembly comprising:

a formed sheet metal bracket member having a base portion adapted to be connected to said second panel and opposite sides, each of said sides having an opening;

a formed sheet metal handle member having an elongated handle portion to be grasped and operated by the user, a paddle portion which extends at both sides from said handle member to form, in plan view, a "T" shape forming opposite wing portions with said lever portion with opposite shaft portions extending from said wing portions and rotatably positioned in said respective side openings;

a moving hasp member formed of wire and having an end portion to hook onto said fixed hasp, a body portion, and two curved portions each forming a bore and each bore containing a wing portion of said paddle portion;

wherein said shaft portions are along a line of turning of said handle member and said wing portions are eccentric to said center of turning and have edges which cam against the internal walls of said bores upon rotational movement of said handle member to open or close said fastener.

2. A fastener as in claim 1 wherein said wire forms, as unitary portions, end clasp portions, respective opposite side arms which are curved when the fastener is open and straightened under tension when the fastener is closed, and respective opposite end curved portions each forming a bore.

* * * * *